US006039549A

United States Patent [19]

Tarng et al.

[11] Patent Number: 6,039,549

[45] Date of Patent: Mar. 21, 2000

[54] VOLUTE COMPRESSOR

[75] Inventors: Guang-Der Tarng, Hsin Chu Hsien; Lung-Tsai Chang, Hsin Chu, both of Taiwan

[73] Assignee: Rechi Precision Co., Ltd., Taoyuan Hsien, Taiwan

[21] Appl. No.: 09/053,685

[22] Filed: Apr. 2, 1998

[51] Int. Cl.[7] ..... F01C 1/02

[52] U.S. Cl. ..... 418/55.5; 418/57

[58] Field of Search ..... 418/55.5, 55.1, 418/57

[56] References Cited

U.S. PATENT DOCUMENTS 5,458,471 10/1995 Ni ..... 418/55.5 X
5,527,166 6/1996 Chang et al. ..... 418/55.5 X
5,551,851 9/1996 Williams et al. ..... 418/55.5 X
5,645,408 7/1997 Fujio et al. ..... 418/57 X
5,846,065 12/1998 Sano et al. ..... 418/55.5 X

*Primary Examiner*—Hoang Nguyen
*Attorney, Agent, or Firm*—Rosenberg, Klein & Lee

[57] ABSTRACT

A volute compressor includes, a frame mounted inside a housing thereof, a fixed volute coupled to the frame at the top, a rotary volute mounted on the frame and defining with the fixed volute a plurality of compression chambers, a plurality of first locating blocks and a plurality of second locating blocks mounted on the frame at the top and spaced around the fixed volute and the rotary volute, a plurality of spring plates connected between the first locating blocks and a shoulder of the fixed volute to stop the fixed volute from rotary motion relative to the rotary volute, and a plurality of stop plates fixedly mounted on the second locating blocks, the stop plates each having a free end suspending above the shoulder of the fixed volute to limit upward movement of the fixed volute.

5 Claims, 5 Drawing Sheets

VOLUTE COMPRESSOR

BACKGROUND OF THE INVENTION

The present invention relates to a volute compressor, and more specifically to the mounting arrangement of the rotary volute and fixed volute in a volute compressor.

FIG. 1 shows a volute compressor according to the prior art. As illustrated, the volute compressor is comprised of a rotary volute 1, a fixed volute 2, a partition block 3, and a frame 14. The rotary volute 1 is tuned around the fixed volute 2 to compress intake flow of low pressure air in compression chambers defined between the rotary volute 1 and the fixed volute 2. The frame 14 is fixedly mounted with four locating blocks 5 to limit floating of the fixed volute 2. However, the locating blocks 5 tend to be damaged or moved out of place during the operation of the volute compressor. Further, because the gaps between the locating blocks 5 and the fixed volute 2 are limited, the precision of the fixed volute 2, the frame 4 and the locating blocks 5 is critical.

SUMMARY OF THE INVENTION

The present invention has been accomplished to provide a volute compressor which eliminates the aforesaid drawbacks. According to one aspect of the present invention, the volute compressor comprises a frame mounted inside a housing thereof, a fixed volute coupled to the frame at the top, a rotary volute mounted on the frame and defining with the fixed volute a plurality of compression chambers, a plurality of first locating blocks and a plurality of second locating blocks mounted on the frame at the top and spaced around the fixed volute and the rotary volute, a plurality of spring plates connected between the first locating blocks and a shoulder of the fixed volute to stop the fixed volute from rotary motion relative to the rotary volute, and a plurality of stop plates fixedly mounted on the second locating blocks, the stop plates each having a free end suspending above the shoulder of the fixed volute to limit upward movement of the fixed volute. According to another aspect of the present invention, the first locating blocks and the second locating blocks can be integral with the frame, or separately made and then fixedly fastened to the frame by screws.

DETAILED DESCRIPTION OF THE PREFERRED EMBODIMENT

Figure 1:
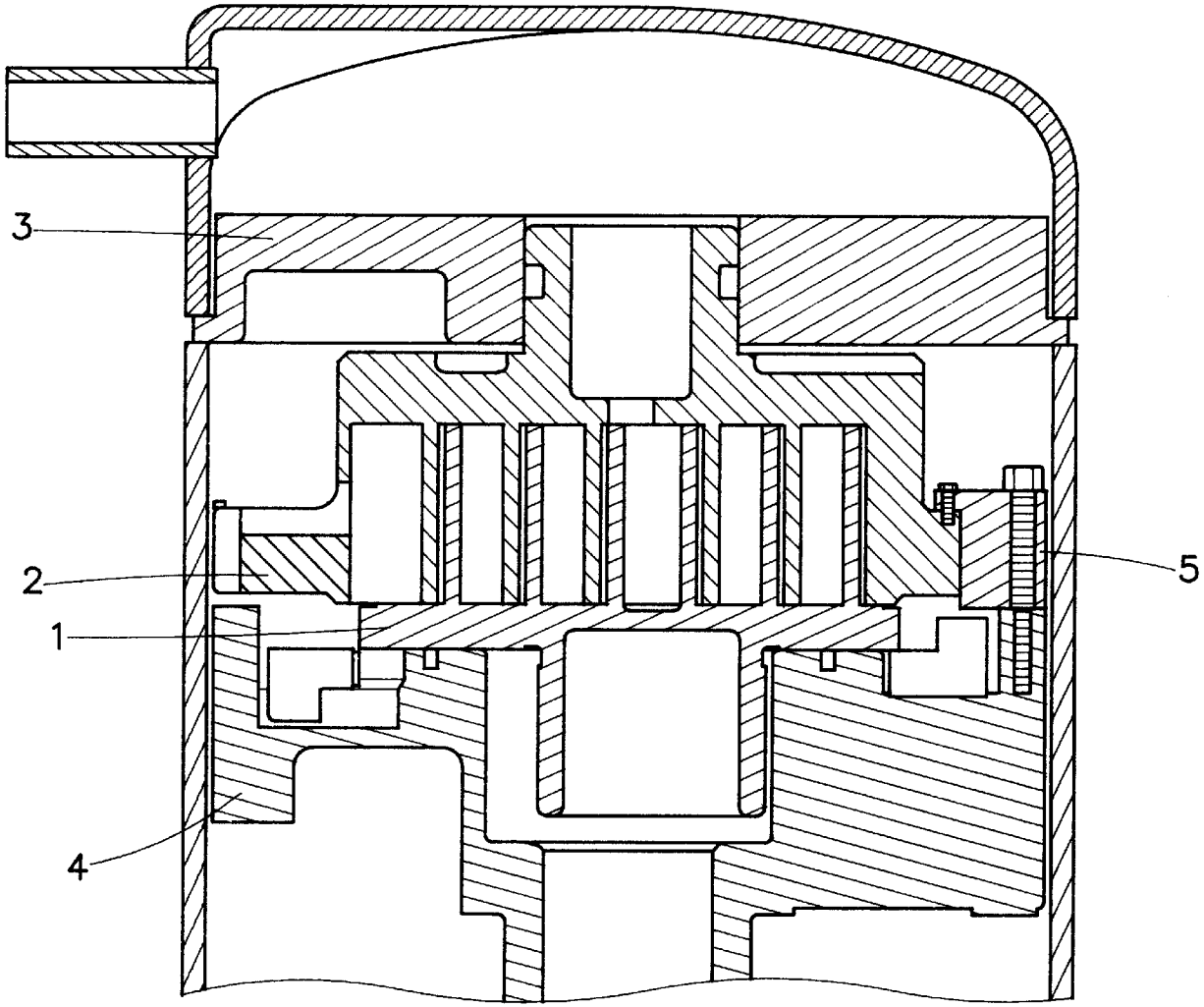
FIG. 1 PRIOR ART
FIG. 1 is a sectional view of a volute compressor according to the prior art.
Figure 2:
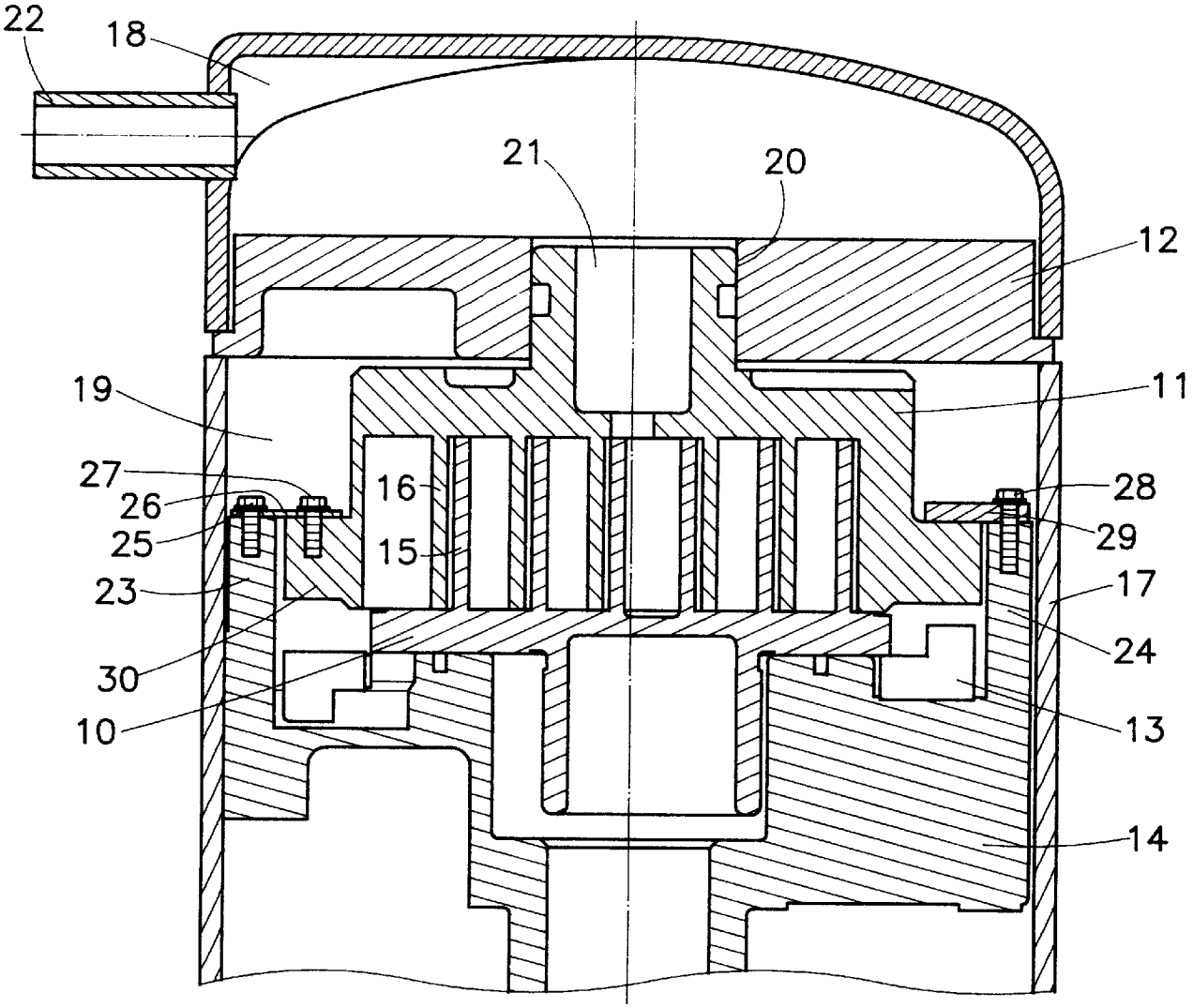
FIG. 2 is a sectional plain view of a volute compressor according to the present invention.
Figure 3:
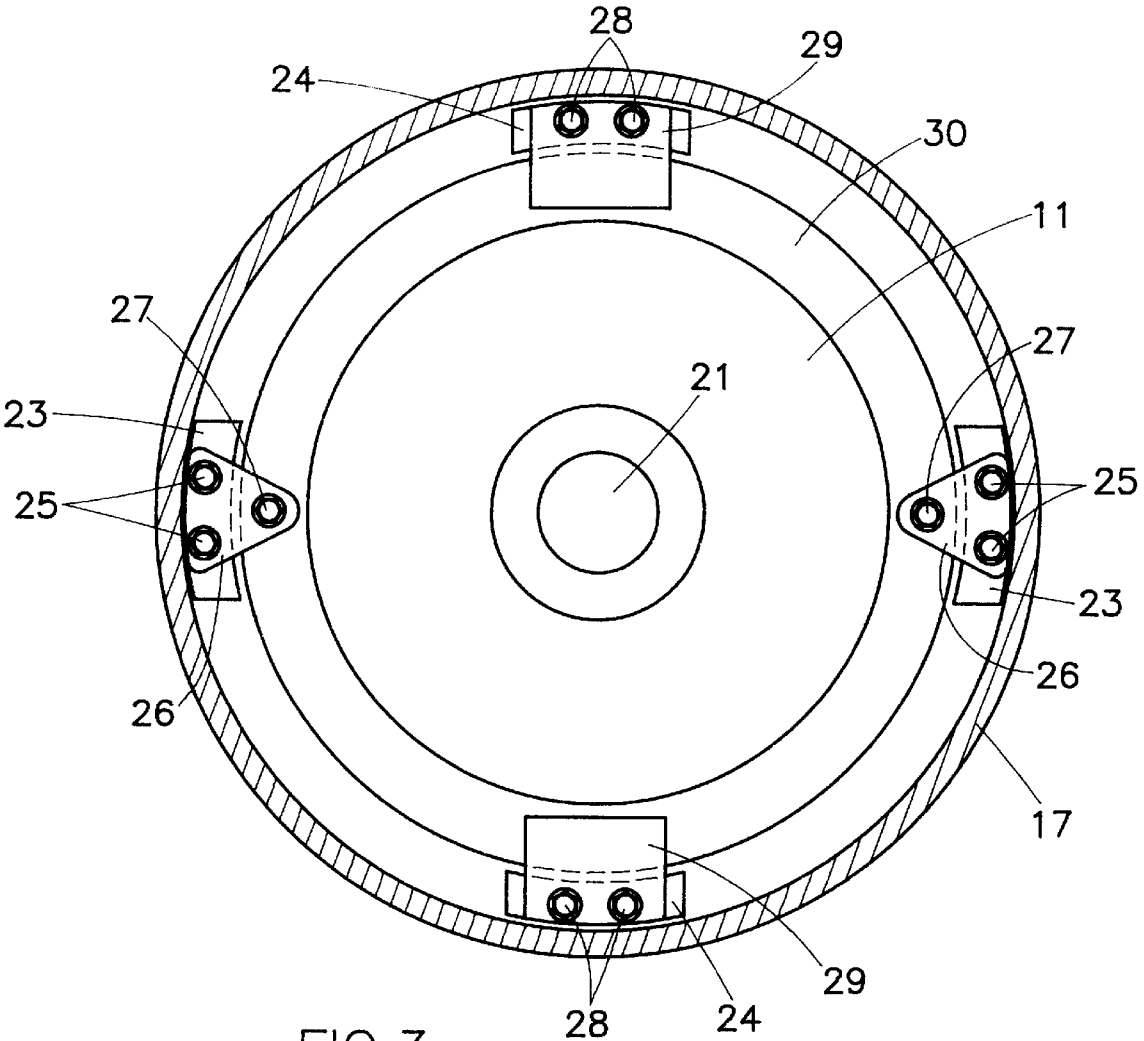
FIG. 3 is a top view of the volute compressor shown in FIG. 2.

Referring to FIGS. 2 and 3, a volute compressor is shown comprised of a rotary volute 10, a fixed volute 11, a partition block 12, a ring 13, and a frame 14. The rotary volute 10 and the fixed volute 11 are mounted on the frame 14 at the top. The rotary volute 10 and the fixed volute 11 are arranged together, defining therebetween a plurality of compression chambers. The ring 13 is mounted on the frame 14 at the top.

When the rotary volute 10 is driven by an external force, the rotary volute 10 is controlled by the ring 13 to revolve around the fixed volute 11, and prohibited from revolving on its own axis. The rotary volute 10 is held down by the fixed volute 11 on the frame 14. The fixed volute 11 is secured to the frame 14. Spiral blades 15;16 of the rotary volute 10 and the fixed volute 11 are arranged together, defining a plurality of compression chambers. The partition block 12 is fixedly mounted inside the housing 17 of the volute compressor, separating the holding space of the housing 17 into a high pressure chamber 18 and a low pressure chamber 19. The partition block 12 has a center through hole 21 which imparts a passage between the high pressure chamber 18 and the low pressure chamber 19. When a low pressure working flow of air is sucked into the compression chambers inside the housing 17, it is turned round and round by the rotary volute 10 and propelled out of an outlet 21 at the center of the fixed volute 11 and then driven out of the housing 17 through an outlet pipe 22.

A plurality of first locating blocks 23 and a plurality of second locating blocks 24 are alternatively and equiangularly mounted on the frame 14 at the top around its border. For example, two first locating blocks 23 and two second locating blocks 24 are alternatively arranged at the top of the frame 14. The locating blocks 23;24 can be integral with the frame 14, or fixedly secured thereto by screws. Each first locating block 23 is fixedly mounted with a substantially triangular spring plate 26. The triangular spring plate 26 has its base (namely, the bottom side) fixedly fastened to one first locating block 23 by screws 25 and its top vertice fixedly fastened to a shoulder 30 of the fixed volute 11 by a screw 27. Each second locating block 23 is fixedly mounted with a rectangular stop plate 29. The rectangular stop plate 29 has one long side (namely, the fixed end) fixedly fastened to one second locating block 24 by screws 28, and an opposite long side (namely, the free end) suspending above the shoulder 30 of the fixed volute 11 to limit upward movement of the fixed volute 11.

Figure 4:
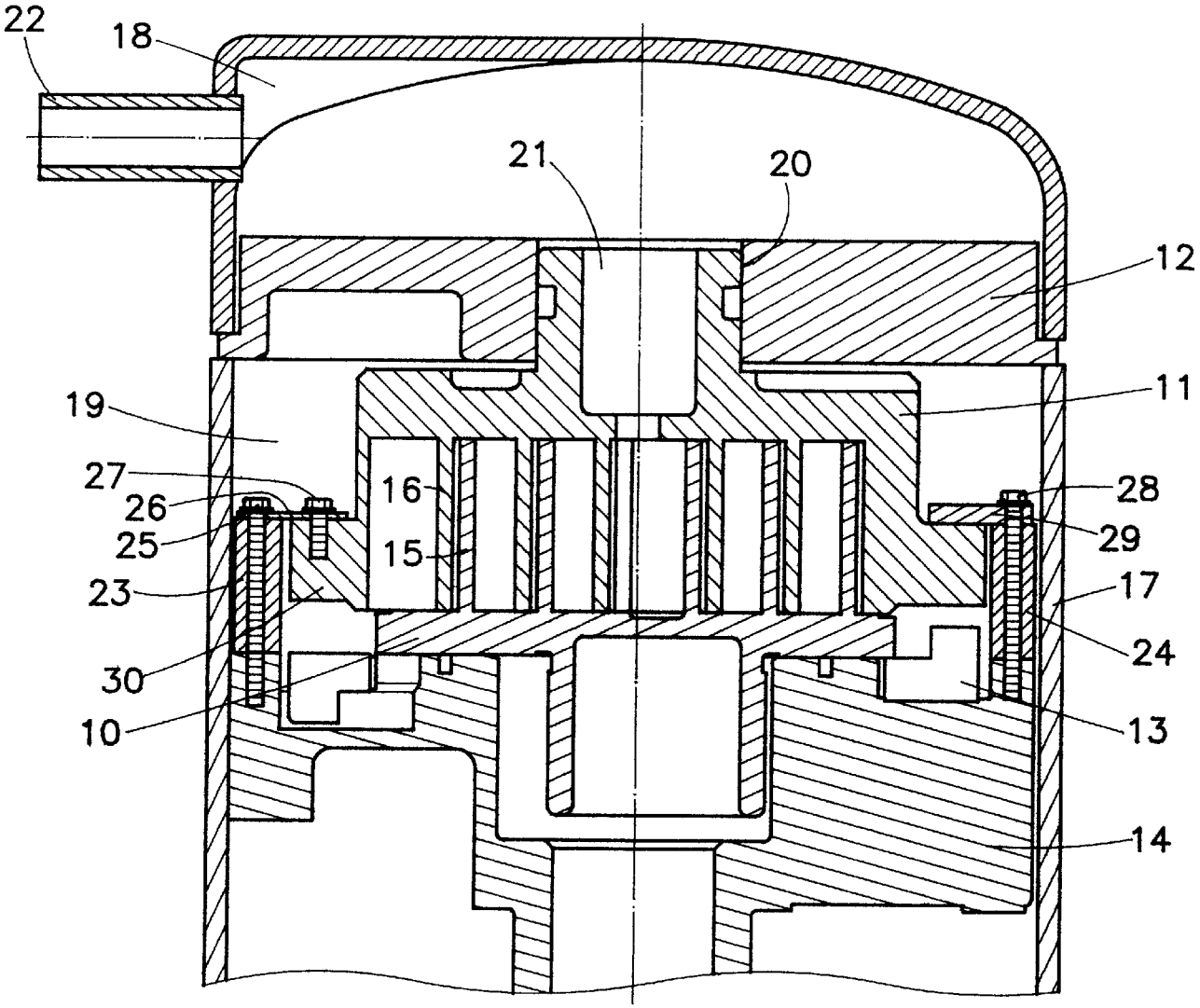
FIG. 4 is a sectional plain view of an alternate form of the volute compressor according to the present invention.
Figure 5:
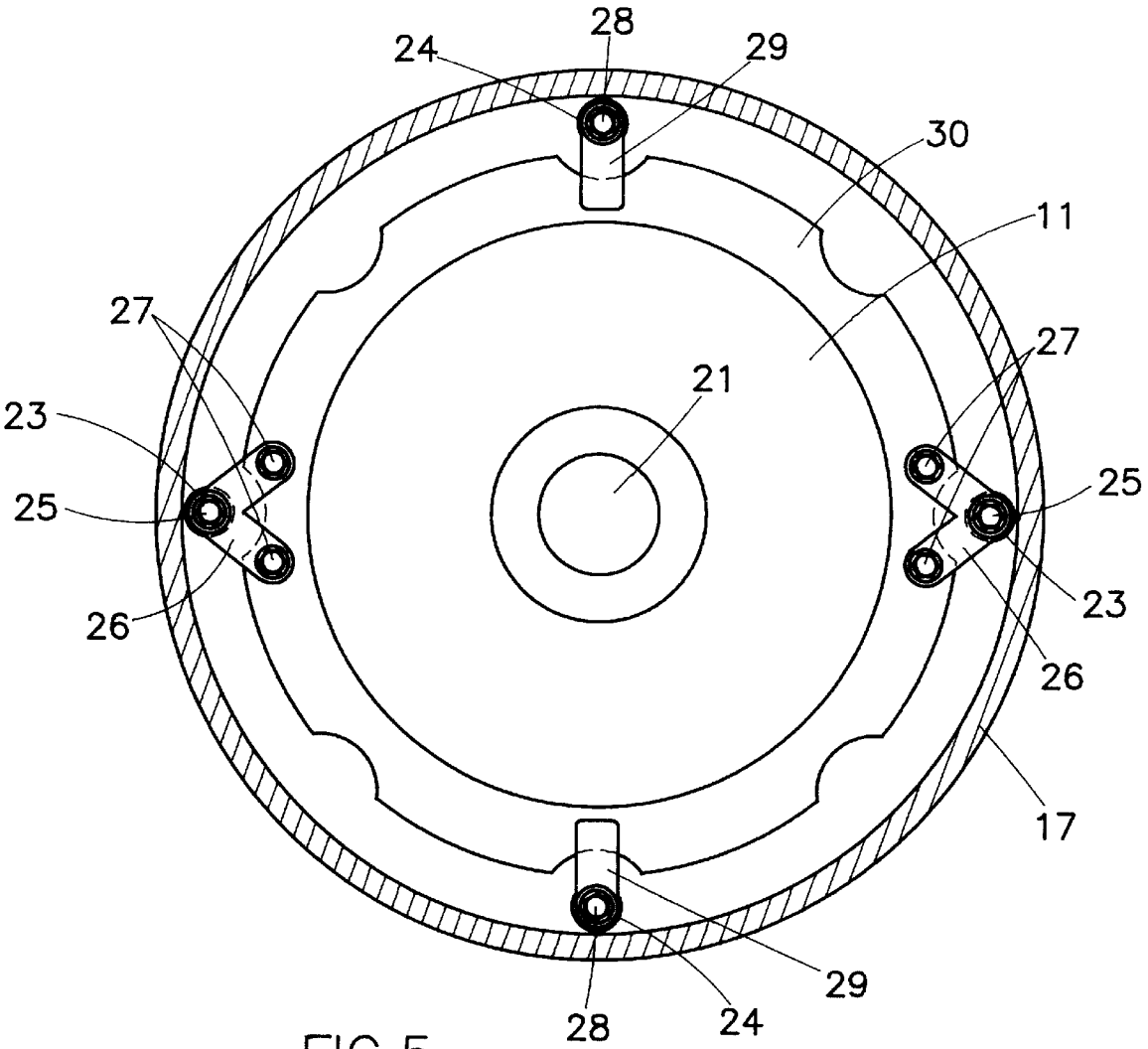
FIG. 5 is a top view of the volute compressor shown in FIG. 4.

FIGS. 4 and 5 show an alternate form of the present invention, in which the spring plates 26 have a substantially V-shaped profile, and are fixedly connected between the first locating blocks 23 and the shoulder 30 of the fixed volute 11; the stop plates 29 are elongated plates, each having a fixed end fixedly fastened to one second locating block 24 by a screw 28 and a free end suspending above the shoulder 30 of the fixed volute 11.

Referring to FIGS. 2 and 4, the stop plates 29 are fixedly fastened to the frame 14 at the top by screws 28 before the installation of the fixed volute 11, then the rotary volute 10 is rotated slowly, and then the screws 25;27 are installed to fix the spring plates 26. Because the spring plates 26 are fixedly connected between the first locating blocks 23 and the shoulder 30 of the fixed volute 11 at the top, the spring plates 26 impart a downward pressure to the fixed volute 11 without stopping the fixed volute 11 from floating vertically. Because the spring plates 26 are connected between the first locating blocks 23 and the fixed volute 11 to stop the fixed volute 11 from a rotary motion, the distance between the fixed volute 11 and the locating blocks 23;24 can be relatively increased to prevent friction between the fixed volute 11 and the locating blocks 23;24 during the operation of the volute compressor.

It is to be understood that the drawings are designed for purposes of illustration only, and are not intended as a definition of the limits and scope of the invention disclosed.

What the invention claimed is:

1. A volute compressor comprising a housing, a frame mounted inside said housing, a fixed volute coupled to said frame at a top side, and a rotary volute mounted on said frame and defining with said fixed volute a plurality of compression chambers, wherein said frame comprises a plurality of first locating blocks and a plurality of second locating blocks at a top side thereof, said first locating blocks and said second locating blocks being spaced around said fixed volute and said rotary volute; a plurality of spring plates are connected between said first locating blocks and a shoulder of said fixed volute to stop said fixed volute from rotary motion relative to said rotary volute; a plurality of stop plates are fixedly mounted on said second locating blocks, said stop plates each having a free end suspending above the shoulder of said fixed volute to limit upward movement of said fixed volute.

2. The volute compressor of claim 1 wherein said first locating blocks and said second locating blocks are respectively integral with said frame.

3. The volute compressor of claim 1 wherein said first locating blocks and said second locating blocks are respectively fastened to said frame by screws.

4. The volute compressor of claim 1 wherein the number of said first locating blocks is 2, and the two first locating blocks are arranged on said frame at two opposite locations.

5. The volute compressor of claim 1 wherein the number of said second locating blocks is 2, and the two second locating blocks are arranged on said frame at two opposite locations.

* * * * *